US009487041B1

(12) United States Patent
Ishida et al.

(10) Patent No.: US 9,487,041 B1
(45) Date of Patent: Nov. 8, 2016

(54) DECOLORIZING APPARATUS, IMAGE FORMING APPARATUS, AND DECOLORIZING METHOD

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventors: Kazufumi Ishida, Shizuoka (JP); Toshifumi Mimura, Kanagawa (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/718,380

(22) Filed: May 21, 2015

(51) Int. Cl.
*B41M 7/00* (2006.01)
*B41J 2/32* (2006.01)

(52) U.S. Cl.
CPC ..... *B41M 7/0009* (2013.01); *B41J 2/32* (2013.01)

(58) Field of Classification Search
CPC .... B41M 7/00; B41M 7/0009; B41M 7/009; G03G 21/00; B41J 2/32
USPC ..... 347/171, 179, 156; 399/167, 328
See application file for complete search history.

(56) References Cited

U.S. PATENT DOCUMENTS 8,487,971 B2 * 7/2013 Yahata ..... B41J 2/32 347/171
8,487,972 B2 * 7/2013 Aoki ..... G03G 21/00 347/179
8,614,725 B2 * 12/2013 Ishii ..... B41J 2/32 347/179
2004/0239749 A1 * 12/2004 Kagawa ..... G03G 15/2053 347/156
2015/0360891 A1 12/2015 Ishida

FOREIGN PATENT DOCUMENTS

JP 2016-001283 1/2016

* cited by examiner

*Primary Examiner* — Kristal Feggins
(74) *Attorney, Agent, or Firm* — Amin, Turocy & Watson LLP

(57) ABSTRACT

A decolorizing apparatus of an exemplary embodiment includes a feeding section, a decolorizing section, and a control section. The feeding section can supply a magnetic medium having a ferromagnet in at least a part thereof. The decolorizing section decolorizes a decolorable image formed on the magnetic medium by heating the magnetic medium. The control section controls the decolorizing section to be set to a temperature which is equal to or higher than a temperature at which the image can be decolorized and is lower than a Curie temperature of the ferromagnet of the magnetic medium during decolorizing of the magnetic medium.

10 Claims, 9 Drawing Sheets

DECOLORIZING APPARATUS, IMAGE FORMING APPARATUS, AND DECOLORIZING METHOD

FIELD

Embodiments described herein relate generally to a decolorizing apparatus, an image forming apparatus, and a decolorizing method.

BACKGROUND

There is a decolorizing apparatus which decolorizes an image formed on a sheet. The decolorizing apparatus heats the sheet at a predetermined temperature or higher. Consequently, the image formed on the sheet is decolorized.

Meanwhile, an ink jet type apparatus, which prints an image on a sheet with a magnetic body called a magnetic sheet attached thereto, is commonly used. The magnetic sheet is much more expensive than paper, and thus repeated use thereof is desirable. For this reason, an image may be formed on a magnetic medium with decolorable toner, but if the formed image is decolorized, the magnetic medium is required to be heated at a predetermined temperature or higher. However, if the magnetic medium is heated at the predetermined or high temperature, the magnetism of the magnetic medium may be weakened.

DETAILED DESCRIPTION

Figure 1:
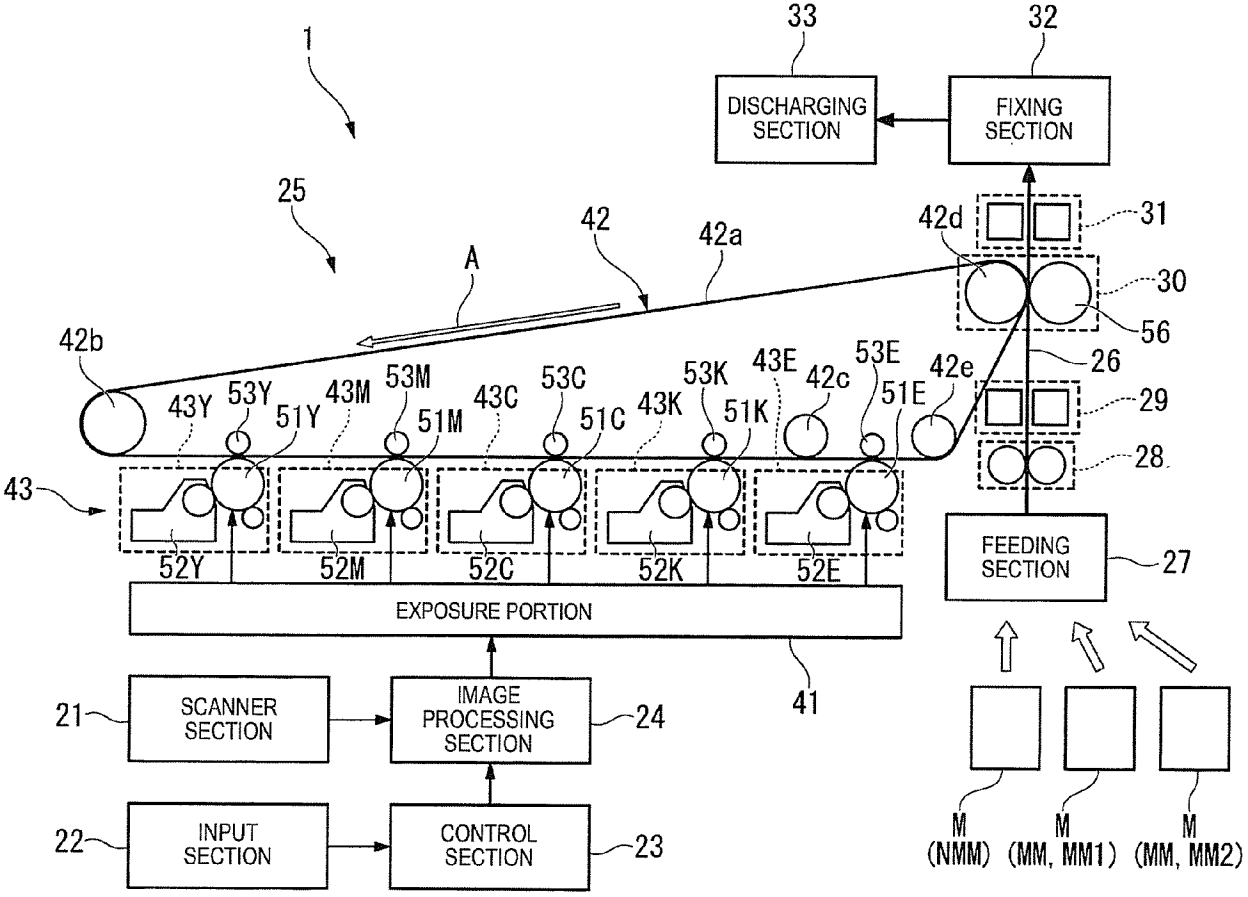
FIG. 1 is a diagram schematically illustrating a configuration example of an image forming apparatus according to a first exemplary embodiment.

A decolorizing apparatus of an exemplary embodiment includes a feeding section, a decolorizing section, and a control section. The feeding section can supply a magnetic medium having a ferromagnet in at least a part thereof. The decolorizing section decolorizes a decolorable image formed on the magnetic medium by heating the magnetic medium. The control section controls the decolorizing section to be set to a temperature which is equal to or higher than a temperature at which the image can be decolorized and is lower than a Curie temperature of the ferromagnet of the magnetic medium during decolorizing of the magnetic medium.

Hereinafter, a decolorizing apparatus, an image forming apparatus, and a decolorizing method of exemplary embodiments will be described with reference to the drawings. In the following description, constituent elements having the same or similar functions are given the same reference numerals. In addition, description of the constituent elements may be omitted.

First Exemplary Embodiment

FIG. 1 illustrates a configuration example of an image forming apparatus 1 according to a first exemplary embodiment. The image forming apparatus 1 is an electrophotographic multi-function peripheral (MFP). The image forming apparatus 1 of the present exemplary embodiment has a decolorizing function as will be described later. Thus, the image forming apparatus 1 is an example of a "decolorizing apparatus".

A sheet-like recording medium (hereinafter, referred to as a "medium") such as paper is supplied to the image forming apparatus 1. The image forming apparatus 1 reads an image formed on an original document. The image forming apparatus 1 generates digital data (image file) from the read image. The image forming apparatus 1 forms an image on the medium on the basis of the digital data. The image forming apparatus 1 forms the image by using a recording agent. For example, the recording agent is toner. The recording agent is either a decolorable recording agent or a non-decolorable recording agent.

A toner material used as the decolorable recording agent is decolorable when energy is applied from the outside. The application of energy from the outside includes application of external stimuli. For example, the application of energy from the outside includes application of external stimuli such as heat, light with a specific wavelength, or pressure. In the present exemplary embodiment, "decolorizing" indicates that an image formed in a color (including not only a chromatic color but also an achromatic color such as white or black) different from a base color of paper is made not to be visually recognized.

First, a medium M supplied to the image forming apparatus 1 will be described.

As illustrated in FIG. 1, the medium M supplied to the image forming apparatus 1 includes a non-magnetic medium NMM and a magnetic medium MM.

The non-magnetic medium NMM is a typical recording medium which does not have substantial magnetism. For example, the non-magnetic medium NMM is a paper sheet (for example, plain paper copier (PPC) paper).

On the other hand, the magnetic medium MM is a recording medium in which at least a part contains a ferromagnetic material. The magnetic medium MM can be attached to a magnetic body (for example, a paramagnet such as a metal member) through a magnetic force. For example, the magnetic medium MM is a sheet on which duplex printing can be performed. In addition, for example, the magnetic medium MM can be attached to a magnetic body on both a front surface and a rear surface.

Figure 2:
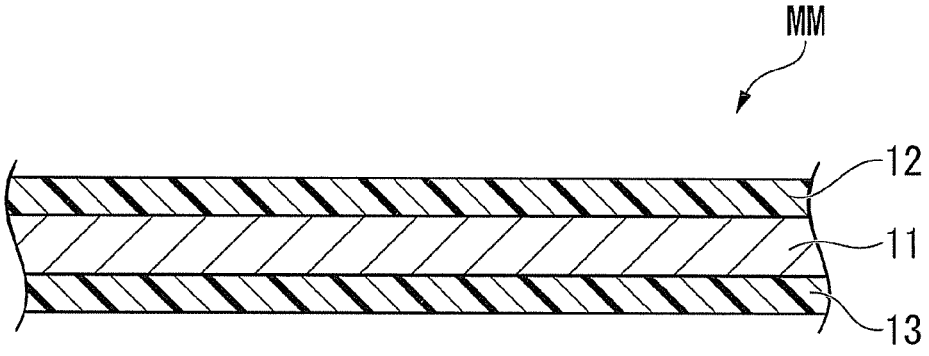
FIG. 2 is a cross-sectional view illustrating an example of a magnetic medium supplied to the image forming apparatus.

FIG. 2 illustrates an example of the magnetic medium MM. As illustrated in FIG. 2, the magnetic medium MM includes a magnetic layer 11 and printing sheets 12 and 13.

The magnetic layer 11 contains a ferromagnet. An example of the ferromagnet is a ferrite magnet formed by using iron oxide powder as a primary raw material. For example, a thickness of the magnetic layer 11 is 0.1 mm to 0.2 mm. For example, a magnetic flux density of the magnetic medium MM is 4.1 mT to 8.5 mT. If the magnetic flux density of the magnetic medium MM is 4.0 mT or higher, the magnetic medium MM can be adsorbed by a magnetic body due to a magnetic force. For example, the magnetic flux density of the magnetic medium MM is 8.3 mT or higher. According to the magnetic medium MM, even if the magnetic medium MM is attached to an erected surface (for example, a surface extending vertically) of a magnetic body due to a magnetic force, the magnetic medium MM does not fall.

The printing sheets 12 and 13 are attached to both sides of the magnetic layer 11. For example, the printing sheets 12 and 13 are sheet pieces made of paper or synthetic resin. As a specific example, the printing sheets 12 and 13 are films (resin layers) made of synthetic resin. For example, each of the printing sheets 12 and 13 is about 0.1 mm to 0.2 mm thick. Images are formed on surfaces of the printing sheets 12 and 13. If the magnetic medium MM is used for simplex printing, either of the printing sheets 12 and 13 may be omitted.

The magnetic layer 11 and the printing sheets 12 and 13 are integrated with each other before an image is printed. In other words, the magnetic medium MM is supplied to the image forming apparatus 1 in a state in which the magnetic layer 11 and the printing sheets 12 and 13 are joined to each other.

The image forming apparatus 1 of the present exemplary embodiment has a decolorizing function. For this reason, a decolorization target medium M is also supplied to the image forming apparatus 1. In other words, the medium M supplied to the image forming apparatus 1 includes a non-magnetic medium NMM on which an image is formed, a magnetic medium MM on which an image is formed, a non-magnetic medium NMM on which an image is decolorized, and a magnetic medium MM on which an image is decolorized.

Next, the entire configuration of the image forming apparatus 1 will be described.

As illustrated in FIG. 1, the image forming apparatus 1 includes a scanner section 21, an input section 22, a control section 23, an image processing section 24, an intermediate transfer section 25, a transport path 26, a feeding section 27, a resist section 28, a first guide section 29, a secondary transfer section 30, a second guide section 31, a fixing section 32, and a discharging section 33.

The scanner section 21 reads image information of an original document as digital data. For example, image information read by the scanner section 21 is used by the image processing section 24.

The input section 22 receives an input from a user. The input section 22 receives selection of an operation mode of the image forming apparatus 1. For example, the selection of the operation mode includes selection of any one of a printing mode in which an image is formed on the non-magnetic medium NMM, a printing mode in which an image is formed on the magnetic medium MM, a decolorizing mode in which an image on the non-magnetic medium NMM is decolorized, and a decolorizing mode in which an image on the magnetic medium MM is decolorized. The decolorizing mode is a mode in which heat is applied to an image formed of a decolorable recording agent and thus the image becomes invisible.

A plurality of types of magnetic media MM having different Curie temperatures may be supplied to the image forming apparatus 1. In this case, the input section 22 receives input indicating the type of supplied magnetic medium MM.

The control section (control circuit) 23 controls the entire image forming apparatus 1. In other words, the control section 23 controls various operations of the scanner section 21, the input section 22, the image processing section 24, the intermediate transfer section 25, the feeding section 27, the resist section 28, the secondary transfer section 30, and the fixing section 32. The control section 23 forms an image on the medium M on the basis of image information read by the scanner section 21 and the content input to the input section 22. The control section 23 decolorizes an image on the medium M on the basis of the content input to the input section 22. The control section 23 will be described later in detail.

The image processing section 24 receives image data from the scanner section 21. The image processing section 24 decomposes the image data received from the scanner section 21 into respective color components. The image processing section 24 outputs the image data which is decomposed into the respective color components to the intermediate transfer section 25.

Next, the intermediate transfer section 25 will be described in detail.

The intermediate transfer section (primary transfer section) 25 includes an exposure portion 41, an intermediate transfer belt portion 42, and a process unit portion 43.

The exposure portion 41 irradiates a surface of each photoconductive drum to be described later in the process unit portion 43 with laser light on the basis of information output from the image processing section 24.

The intermediate transfer belt portion 42 includes an intermediate transfer belt 42*a* and four rollers 42*b*, 42*c*, 42*d* and 42*e*. The intermediate transfer belt 42*a* has an endless shape. The intermediate transfer belt 42*a* is hung and rotated on the rollers 42*b*, 42*c*, 42*d* and 42*e*. The intermediate transfer belt 42*a* can perform endless traveling in a direction indicated by an arrow A of FIG. 1.

The process unit portion 43 includes a plurality of process units 43Y, 43M, 43C, 43K and 43E. For example, the plurality of process units 43Y, 43M, 43C, 43K and 43E include four non-decolorable image forming units 43Y, 43M, 43C and 43K and a single decolorable image forming unit 43E. In addition, a plurality of decolorable image forming units may be provided.

The four non-decolorable image forming units 43Y, 43M, 43C and 43K include a yellow image forming unit 43Y, a magenta image forming unit 43M, a cyan image forming unit 43C, and a black image forming unit 43K. Non-decolorable recording agents (recording agent having no decolorization function) corresponding to the respective colors can be mounted on the four non-decolorable image forming units 43Y, 43M, 43C and 43K. On the other hand, a decolorable recording agent (a recording agent having a decolorization function) can be mounted on the decolorable image forming unit 43E. For example, the decolorable image forming unit 43E has a black recording agent as one of the recording agents which are frequently used.

Each of the process units 43Y, 43M, 43C, 43K and 43E includes a photoconductive drum 51, a developing unit 52, and a transfer roller 53. Configurations of the process units 43Y, 43M, 43C, 43K and 43E are the same as each other except for colors of recording agents or with or without decolorable properties. For this reason, in FIG. 1, letters Y, M, C, K, and E respectively indicating yellow, magenta, cyan, black, and a decolorable property are added to the reference numerals of the respective constituent elements.

The exposure portion 41 irradiates surfaces of the photoconductive drums 51Y, 51M, 51C, 51K and 51E with laser light. Thus, electrostatic latent images based on image data are formed on the respective surfaces of the photoconductive drums 51Y, 51M, 51C, 51K and 51E.

The developing units 52Y, 52M, 52C, 52K and 52E respectively supply recording agents onto the surfaces of the photoconductive drums 51Y, 51M, 51C, 51K and 51E. Consequently, the recording agents are attached to the latent image portions of the respective photoconductive drums 51Y, 51M, 51C, 51K and 51E.

Here, the recording agent supplied to each of the developing units 52Y, 52M, 52C, 52K and 52E is a two-component developer. The two-component developer is a mixture of a magnetic carrier and toner. For example, the magnetic carrier is iron powder or a polymer ferrite particle. The magnetic carrier gives triboelectric charge to the toner. The toner is carried to the surfaces of the photoconductive drums 51Y, 51M, 510, 51K and 51E due to the magnetism of the magnetic carriers. In the present exemplary embodiment, the toner of the two-component developer supplied to the developing units 52Y, 52M, 52C, 52K and 52E is non-magnetic toner. If the toner is non-magnetic, the toner is not influenced by the magnetic force of the magnetic medium MM when the toner is transferred to the magnetic medium MM. For this reason, the toner can be transferred to an intended position on a surface of the magnetic medium.

The transfer rollers 53Y, 53M, 53C, 53K and 53E are in contact with the intermediate transfer belt 42*a* from an opposite side to the photoconductive drums 51Y, 51M, 51C, 51K and 51E. Consequently, the toner is (primarily) transferred from the surfaces of the photoconductive drums 51Y, 51M, 51C, 51K and 51E to the intermediate transfer belt 42*a*.

Next, a description will be made of the transport path 26, the feeding section 27, the resist section 28, the first guide section 29, the secondary transfer section 30, the second guide section 31, the fixing section 32, and the discharging section 33.

The transport path 26 extends from the feeding section 27 to the discharging section 33 via the resist section 28, the first guide section 29, the secondary transfer section 30, the second guide section 31, and the fixing section 32. The medium M is transported along the transport path 26.

The feeding section 27 includes a feeding cassette (or a feeding tray) and a pickup roller. The above-described four types of media M (that is, the non-magnetic medium NMM on which an image is formed, the magnetic medium MM on which an image is formed, the non-magnetic medium NMM on which an image is decolorized, and the magnetic medium MM on which an image is decolorized) are supplied to the feeding cassette (or the feeding tray) depending on the purpose thereof. The pickup roller forwards the medium M to the transport path 26.

The resist section (resist roller pair) 28 is provided between the feeding section 27 and the secondary transfer section 30. The resist section 28 temporarily confines the medium M. Thus, the medium M is temporarily stopped. The resist section 28 forwards the medium M toward the secondary transfer section 30 in accordance with transport timing of the toner which is transferred onto the intermediate transfer belt 42*a*. In addition, the resist section 28 aligns an attitude of the medium M on the transport path 26.

The first guide section 29 is located between the resist section 28 and the secondary transfer section 30. The first guide section 29 guides the medium M passing through the resist section 28 to the secondary transfer section 30.

The secondary transfer section 30 includes a transfer roller 56. The transfer roller 56 is in contact with an outer surface of the intermediate transfer belt 42*a*. For example, the transfer roller 56 is a single-layer foam roller. For example, the transfer roller 56 has a sector hardness of 35° in an environment in which a temperature is 23° C. and humidity is 50%. The intermediate transfer section 25 and the secondary transfer section 30 may be collectively referred to as a "transfer section".

The belt roller 42*d* of the intermediate transfer belt portion 42 is included in constituent elements of the secondary transfer section 30. The belt roller 42*d* opposes the transfer roller 56 with the intermediate transfer belt 42*a* interposed therebetween. The transfer roller 56 is in contact with the intermediate transfer belt 42*a* and is rotated. The medium M is pinched along with the intermediate transfer belt 42*a* between the transfer roller 56 and the belt roller 42*d*. At this time, the transfer roller 56 applies a high pressure bias to the medium M. Consequently, the toner on the intermediate transfer belt 42*a* is (secondarily) transferred onto the surface of the medium M. The medium M passing through the secondary transfer section 30 is forwarded toward the fixing section 32.

The second guide section 31 is located between the secondary transfer section 30 and the fixing section 32. The second guide section 31 guides the medium M passing through the secondary transfer section 30 to the fixing section 32.

The fixing section 32 fixes the toner transferred onto the medium M, to the medium M. Thus, an image is formed on the medium M.

In addition, the fixing section 32 decolorizes an image on a decolorization target medium M. In other words, the decolorization target medium M is carried to the fixing section 32 from the feeding section 27 along the transport path 26. The fixing section 32 heats the medium M at a predetermined temperature or higher so as to decolorize the image on the medium M. Thus, the fixing section 32 of the present exemplary embodiment corresponds to an example of a "decolorizing section". The fixing section 32 will also be described later in detail.

The medium M passing through the fixing section 32 is discharged to the discharging section 33. In other words, the medium M on which an image is formed by the fixing section 32 and the medium M on which an image is decolorized by the fixing section 32 are discharged to the discharging section 33.

Next, the fixing section 32 will be described in detail.

Figure 3:
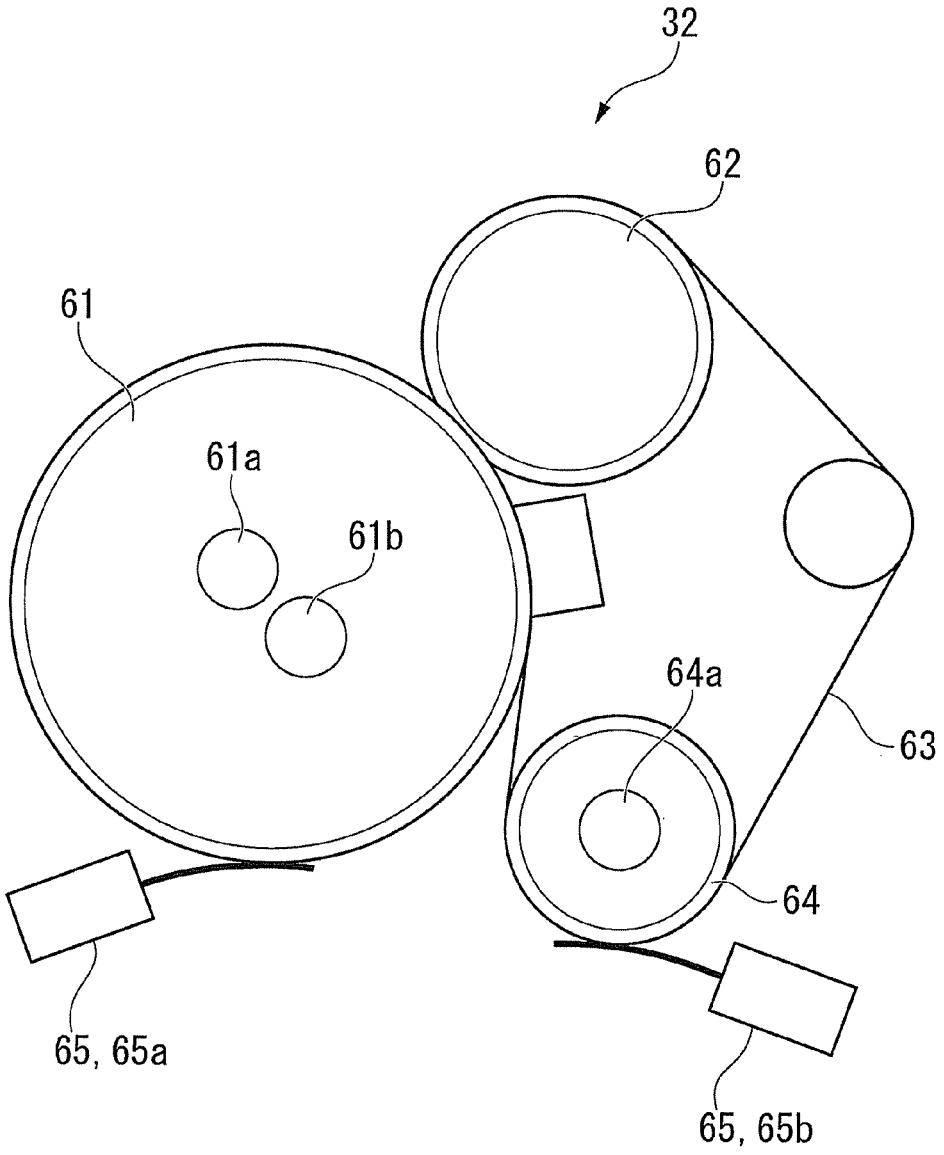
FIG. 3 is a front view illustrating a fixing section.

FIG. 3 illustrates details of the fixing section 32. The fixing section 32 includes a heating roller 61, a press roller 62, a fixing belt 63, a belt heating roller 64, and a temperature sensor 65.

The heating roller (fixing roller) 61 includes a center lamp 61*a* and a side lamp 61*b*. The center lamp 61*a* and the side lamp 61*b* are built into the heating roller 61. The center lamp 61*a* and the side lamp 61*b* heat the heating roller 61. The heating roller 61 is controlled to be set to a fixation temperature (printing temperature) in a printing mode. Consequently, the heating roller 61 applies heat to the medium M. The fixation temperature is a temperature suitable for fixing toner to the medium M.

The press roller 62 applies pressure to the medium M from an opposite side to the heating roller 61.

The fixing belt 63 guides the medium M forwarded to the fixing section 32, to a gap between the heating roller 61 and the press roller 62. The medium M carried on the fixing belt 63 is pinched between the heating roller 61 and the press roller 62 so as to be heated and pressed. Thus, the toner transferred onto the medium M is fixed to the medium M.

The medium M passing through the fixing section 32 is discharged to the discharging section 33.

The belt heating roller 64 supports the fixing belt 63 along with the press roller 62. The belt heating roller 64 includes a belt lamp 64*a*. The belt lamp 64*a* is built into the belt heating roller 64. The belt lamp 64*a* heats the fixing belt 63. The belt heating roller 64 is controlled to be set to a fixation temperature in a printing mode in the same manner as the heating roller 61.

The image forming apparatus 1 of the present exemplary embodiment operates in a decolorizing mode in addition to the printing mode. In the decolorizing mode, the fixing section 32 (the heating roller 61 and the belt heating roller 64) is controlled to be set to a decolorization temperature which is higher than the fixation temperature. The decolorization temperature is a temperature at which the medium M is sufficiently heated in order to decolorize an image on the medium M. The decolorization target medium M passes through the fixing section 32 which is controlled to be set to the decolorization temperature and is thus heated by the heating roller 61 and the fixing belt 63. Thus, the image on the medium M is decolorized.

The temperature sensor (fixing section temperature sensor) 65 is provided in the fixing section 32. The temperature sensor 65 detects a temperature of the fixing section 32. The fixing section temperature sensor 65 of the present exemplary embodiment includes a first thermistor 65*a* and a second thermistor 65*b*. The first thermistor 65*a* is in contact with the heating roller 61. Thus, the first thermistor 65*a* can detect a temperature of the heating roller 61. On the other hand, the second thermistor 65*b* is in contact with the fixing belt 63. Thus, the second thermistor 65*b* can detect a temperature of the fixing belt 63. A detection result from the temperature sensor 65 is sent to the control section 23.

The temperature sensor 65 may include either the first thermistor 65*a* or the second thermistor 65*b*. The temperature sensor 65 is not limited to the first thermistor 65*a* and the second thermistor 65*b*. For example, the temperature sensor 65 may measure a temperature near the fixing section 32 so as to detect a temperature of the fixing section 32.

Figure 4:
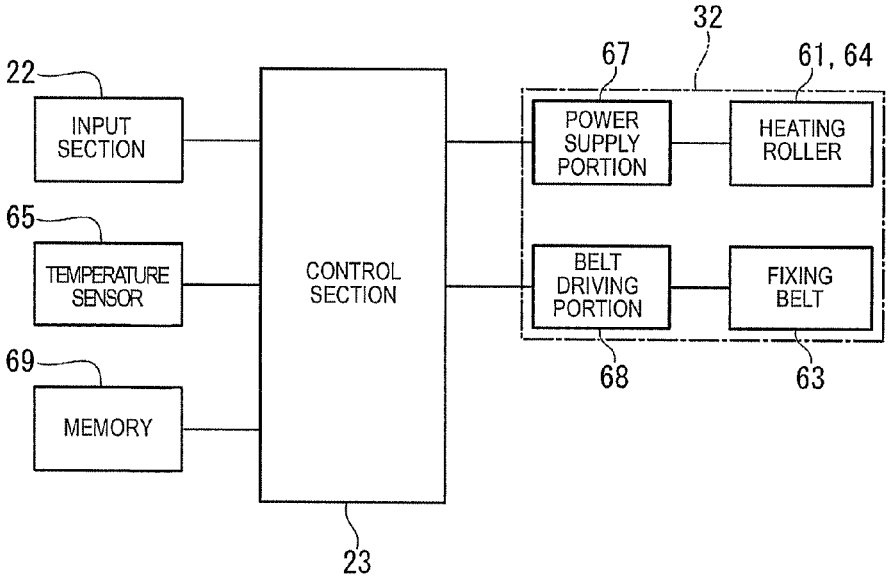
FIG. 4 is a functional block diagram related to control of the fixing section.

FIG. 4 illustrates a functional block diagram of the image forming apparatus 1 related to control of the fixing section 32. As illustrated in FIG. 4, the fixing section 32 includes a power supply portion 67 and a belt driving portion 68 in addition to the above-described constituent elements.

The power supply portion 67 supplies power to the center lamp 61*a* and the side lamp 61*b* of the heating roller 61 and the belt lamp 64*a* of the belt heating roller 64 on the basis of an instruction from the control section 23. Thus, the center lamp 61*a*, the side lamp 61*b*, and the belt lamp 64*a* are heated. Consequently, the heating roller 61 and the fixing belt 63 are heated. The control section 23 gives an instruction to the power supply portion 67 so as to control a temperature of the fixing section 32.

The belt driving portion 68 drives the fixing belt 63 via at least one roller on which the fixing belt 63 is hung. The control section 23 gives an instruction to the belt driving portion 68 so as to control a rotation speed (feeding speed) of the fixing belt 63. In other words, the control section 23 gives an instruction to the belt driving portion 68 so as to control a speed at which the medium M passes through the fixing section 32 (the time required for the medium M to pass through the fixing section 32).

As illustrated in FIG. 4, the image forming apparatus 1 further includes a memory 69. The memory 69 stores an appropriate temperature and an appropriate feeding speed of the fixing section 32 in each operation mode of the image forming apparatus 1. In other words, an appropriate temperature and an appropriate feeding speed of the fixing section 32 during printing of the non-magnetic medium NMM, an appropriate temperature and an appropriate feeding speed of the fixing section 32 during printing of the magnetic medium MM, and the like are set in the memory 69 in advance. In addition, an appropriate temperature and an appropriate feeding speed of the fixing section 32 during decolorizing of the non-magnetic medium NMM, an appropriate temperature and an appropriate feeding speed of the fixing section 32 during decolorizing of the magnetic medium MM, and the like are set in the memory 69 in advance. If there is a possibility that a plurality of types of magnetic media MM may be supplied to the image forming apparatus 1, an appropriate temperature and an appropriate feeding speed of the fixing section 32 are set for each type of magnetic medium MM in advance.

Next, the control section 23 will be described in detail.

The control section 23 of the present exemplary embodiment controls the fixing section 32 to be set to a predetermined temperature during printing of the magnetic medium MM. The predetermined temperature is equal to or higher than a temperature at which toner can be fixed to the magnetic medium MM, and is a temperature which is lower than the Curie temperature of the ferromagnet of the magnetic medium MM.

The control section 23 controls the fixing section 32 to be set to another predetermined temperature during decolorizing of the magnetic medium MM. The predetermined temperature is equal to or higher than a temperature at which an image formed on the magnetic medium MM can be decolorized, and is a temperature which is lower than the Curie temperature of the ferromagnet of the magnetic medium MM.

Specifically, the control section 23 determines an operation mode of the image forming apparatus 1 on the basis of the content input to the input section 22. In other words, the control section 23 determines which operation mode is performed among printing of an image on the non-magnetic medium NMM, printing of an image on the magnetic medium MM, decolorizing of an image on the non-magnetic medium NMM, and decolorizing of an image on the magnetic medium MM.

There is a possibility that a plurality of types of magnetic media MM having different Curie temperatures may be supplied to the image forming apparatus 1. The Curie temperature greatly differs depending on the type of ferromagnet used. Therefore, in the present exemplary embodiment, the input section 22 receives input indicating the type of magnetic medium MM to be supplied. The control section 23 determines the type of magnetic medium MM to be supplied on the basis of the content input to the input section 22.

The control section 23 reads information regarding an appropriate temperature and an appropriate feeding speed of the fixing section 32 corresponding to each operation mode from the memory 69 on the basis of the determination result of the operation mode. The control section 23 controls a temperature and a feeding speed of the fixing section 32 on the basis of the information read from the memory 69 and a detection result from the temperature sensor 65.

Next, a description will be made of a specific example of a decolorizing operation of the image forming apparatus 1. Here, for convenience of description, a single type of non-magnetic medium NMM and two types of magnetic media MM having different Curie temperatures are assumed to be supplied to the image forming apparatus 1. Of the two types of magnetic media MM, a magnetic medium MM having a higher Curie temperature is referred to as a "magnetic medium MM1", and a magnetic medium MM having a lower Curie temperature is referred to as a "magnetic medium MM2".

The control section 23 controls the fixing section 32 to be set to a first temperature during decolorizing of the non-magnetic medium NMM. For example, the first temperature is higher than a Curie temperature of a ferromagnet of at least one type of magnetic medium MM (for example, the magnetic medium MM2). In addition, the first temperature may be higher than Curie temperatures of ferromagnets of all magnetic media MM.

The control section 23 causes the non-magnetic medium NMM to pass through the fixing section 32 at a first speed during decolorizing of the non-magnetic medium NMM. The first speed is a speed at which an image on the non-magnetic medium NMM can be sufficiently decolorized by the fixing section 32 which is controlled to be set to the first temperature. In other words, the first speed is a speed at which the non-magnetic medium NMM can be sufficiently heated to a decolorable level even if the non-magnetic medium NMM passes through the fixing section 32 at this first speed.

On the other hand, the control section 23 controls the fixing section 32 to be set to a second temperature which is lower than the first temperature during decolorizing of one magnetic medium MM1. The second temperature is lower than a Curie temperature of a ferromagnet of the magnetic medium MM1. The second temperature may be higher than a Curie temperature of a ferromagnet of the other magnetic medium MM2.

The control section 23 causes the magnetic medium MM1 to pass through the fixing section 32 at a second speed during decolorizing of the magnetic medium MM1. For example, the second speed is lower than the first speed. The second speed is a speed at which an image on the magnetic medium MM1 can be sufficiently decolorized by the fixing section 32 which is controlled to be set to the second temperature. In other words, the second speed is a speed at which the magnetic medium MM1 can be sufficiently heated to a decolorable level even if the magnetic medium MM1 passes through the fixing section 32 at this second speed.

The control section 23 controls the fixing section 32 to be set to a third temperature which is lower than the second temperature during decolorizing of the other magnetic medium MM2. The third temperature is lower than the Curie temperature of the ferromagnet of the magnetic medium MM2.

The control section 23 causes the magnetic medium MM2 to pass through the fixing section 32 at a third speed during decolorizing of the magnetic medium MM2. For example, the third speed is lower than the second speed. The third speed is a speed at which an image on the magnetic medium MM2 can be sufficiently decolorized by the fixing section 32 which is controlled to be set to the third temperature. In other words, the third speed is a speed at which the magnetic medium MM2 can be sufficiently heated to a decolorable level even if the magnetic medium MM2 passes through the fixing section 32 at this third speed.

The above description relates to an example of the decolorizing operation of the control section 23.

Next, a detailed description will be made of a configuration of the transport path 26. The transport path 26 of the present exemplary embodiment has a configuration suitable for transport of the magnetic medium MM.

Figure 5:
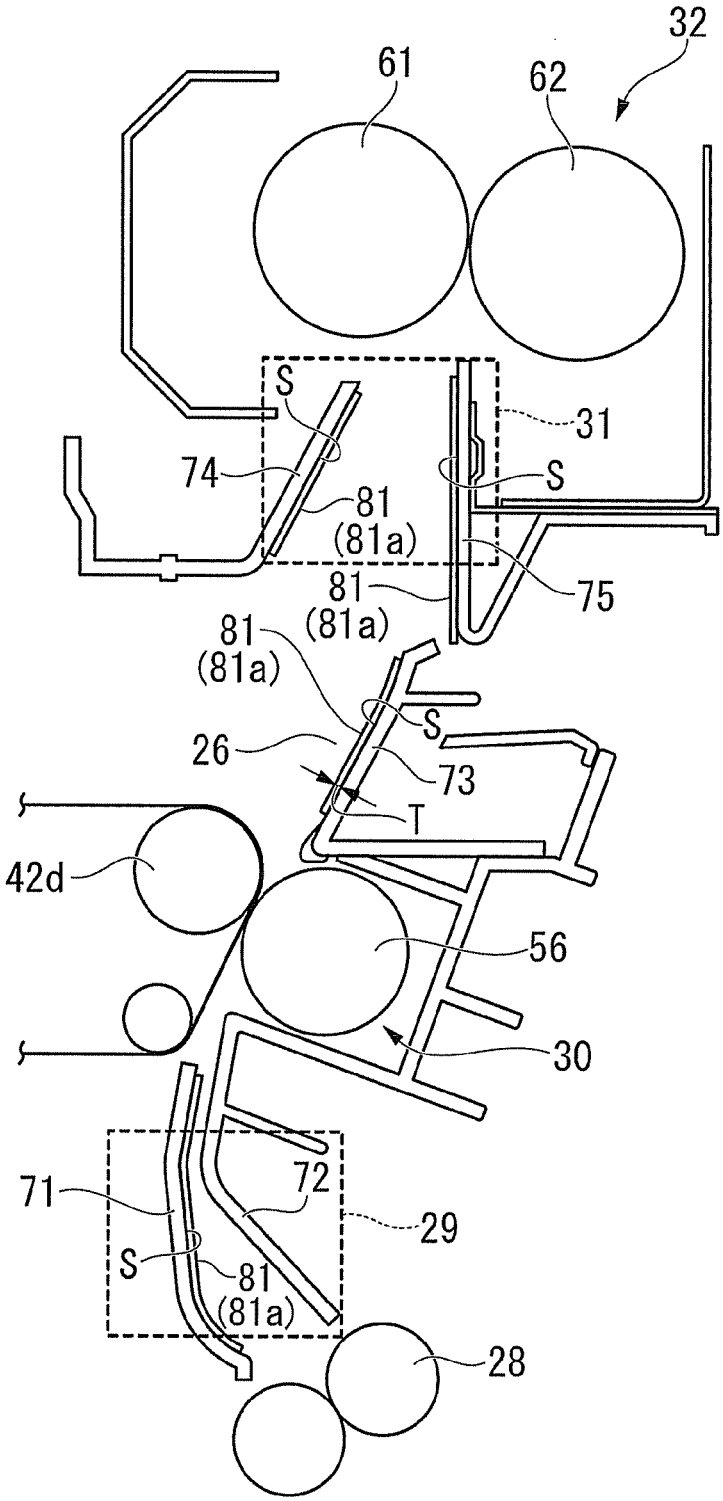
FIG. 5 is a front view illustrating a transport path in FIG. 1.

FIG. 5 illustrates a configuration of the transport path 26 located between the resist section 28 and the fixing section 32. The image forming apparatus 1 includes first to fifth transport guides 71, 72, 73, 74 and 75 and spacers 81. The transport guides 71, 72, 73, 74 and 75 are in contact with the transport path 26. The respective transport guides 71, 72, 73, 74 and 75 are disposed along the transport path 26. Each of the transport guides 71, 72, 73, 74 and 75 has a guide surface S which is in contact with the transport path 26.

The transport guides 71, 72, 73, 74 and 75 have magnetism. For example, the transport guides 71, 72, 73, 74 and 75 are magnetic bodies such as a metal member. If the transport guides 71, 72, 73, 74 and 75 are formed of the metal member, strength or manufacturability of the transport guides 71, 72, 73, 74 and 75 is favorable. On the other hand, if the transport guides 71, 72, 73, 74 and 75 are formed of a magnetic body, the magnetic medium MM may be adsorbed by the transport guides 71, 72, 73, 74 and 75 due to a magnetic force.

Hereinafter, the transport guides 71, 72, 73, 74 and 75 will be described more in detail.

The first and second transport guides 71 and 72 are disposed between the resist section 28 and the secondary transfer section 30. The first and second transport guides 71 and 72 constitute an example of the first guide section 29. The first and second transport guides 71 and 72 are respectively disposed on both sides of the transport path 26. The first and second transport guides 71 and 72 guide the medium M passing through the resist section 28 to the secondary transfer section 30.

The third transport guide 73 is disposed between the secondary transfer section 30 and the fourth and fifth transport guides 74 and 75. The third transport guide 73 guides the medium M passing through the secondary transfer section 30 to the fourth and fifth transport guides 74 and 75.

The fourth and fifth transport guides 74 and 75 are disposed between the third transport guide 73 and the fixing section 32. The fourth and fifth transport guides 74 and 75 constitute an example of the second guide section 31. The fourth and fifth transport guides 74 and 75 are respectively disposed on both sides of the transport path 26. The fourth and fifth transport guides 74 and 75 guide the medium M guided by the third transport guide 73, to the fixing section 32.

For example, the spacer 81 is attached to the guide surface S of each of the first, third, fourth and fifth transport guides 71, 73, 74 and 75. In other words, the spacer 81 is disposed between the guide surface S of each of the transport guides 71, 73, 74 and 75 and the transport path 26. In addition, in the present exemplary embodiment, the second transport guide 72 is located at a position where the medium M is unlikely to be adsorbed. For this reason, in the present exemplary embodiment, the spacer 81 is not attached to the guide surface S of the second transport guide 72. Further, the spacer 81 may be attached to the guide surface S of the second transport guide 72.

For example, the spacer 81 has a thickness T of 1 mm or more between each of the transport guides 71, 73, 74 and 75 and the transport path 26. The spacer 81 is a non-magnetic member which is attached to the transport guides 71, 73, 74 and 75. For example, the spacer 81 is a sheet 81*a* made of a flexible synthetic resin. The spacer 81 is attached to each of the transport guides 71, 73, 74 and 75 and is deformed while traveling on the track of an exterior of each of the transport guides 71, 73, 74 and 75. Thus, the spacer 81 has a shape disposed along the exterior of each of the transport guides 71, 73, 74 and 75. For example, the spacer 81 covers half or more of the area of the guide surface S of each of the transport guides 71, 73, 74 and 75. For example, a material of the spacer 81 is a polyester film or a polyimide sheet. In addition, a material of the spacer 81 is not limited to the above-described example. A material of the spacer 81 may be general purposed plastic such as an ABS resin or a polyethylene resin. Alternatively, a material of the spacer 81 may be an engineering plastic such as a polyacetal resin.

The spacer 81 is not limited to the sheet 81*a* which is formed separately from each of the transport guides 71, 73, 74 and 75. The spacer 81 may be a coating layer provided on each surface of the transport guides 71, 73, 74 and 75.

The spacer 81 is attached to each of the transport guides 71, 73, 74 and 75, and thus the magnetic medium MM is separated from each of the transport guides 71, 73, 74 and 75 by a predetermined amount of distance. The predetermined distance is a distance which causes the magnetic medium MM not to be adsorbed by each of the transport guides 71, 73, 74 and 75 due to a magnetic force.

Figure 6:
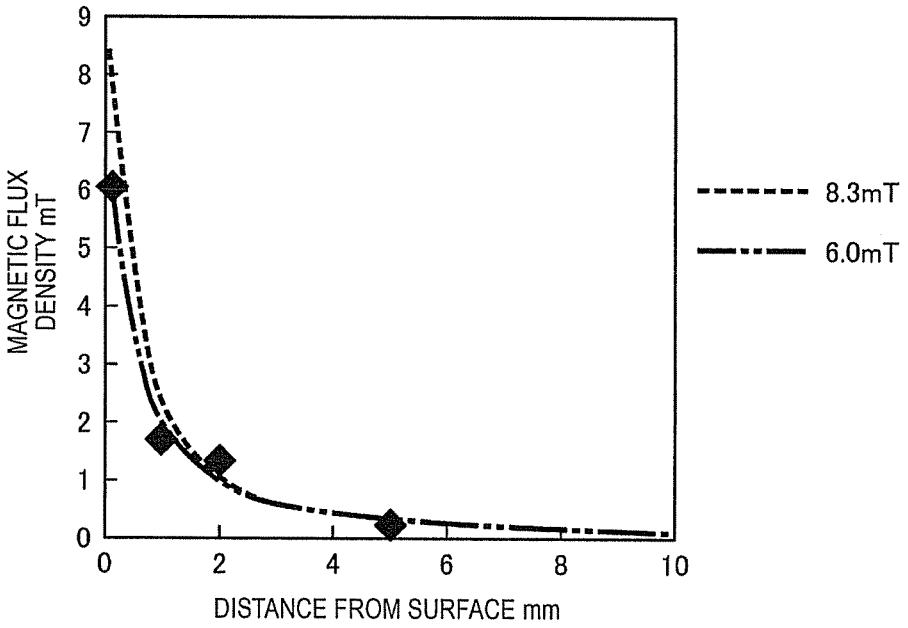
FIG. 6 is a graph illustrating a relationship between the distance from a surface of a magnetic medium and a magnetic flux density.

FIG. 6 is a graph illustrating a relationship between a distance from a surface of the magnetic medium MM and a magnetic flux density. FIG. 6 illustrates a measurement result in a state in which the magnetic medium MM is stopped with respect to a magnetic body. The magnetic body mentioned here corresponds to each of the transport guides 71, 73, 74 and 75. As described above, in the present exemplary embodiment, the magnetic medium MM having a magnetic flux density of 4.1 mT to 8.5 mT is used. For this reason, FIG. 6 illustrates a change in a magnetic flux density acting between the magnetic body and the magnetic medium MM with respect to the magnetic medium MM having a magnetic flux density of 6.0 mT and the magnetic medium MM having a magnetic flux density of 8.3 mT.

As illustrated in FIG. 6, the magnetic flux density rapidly decreases as a distance from the magnetic medium MM increases. In the magnetic medium MM (a magnetic medium having a magnetic flux density of 4.1 mT to 8.5 mT) used in the present exemplary embodiment, if a distance between a magnetic body and the magnetic medium MM is 1 mm or more, a magnetic flux density cannot be obtained in which the magnetic medium MM is adsorbed by the magnetic body due to a magnetic force. Therefore, a surface of the magnetic body and the magnetic medium MM are preferably disposed with a distance therebetween of 1 mm or more.

Next, an example of a thickness necessary in the spacer 81 will be described more in detail.

If the magnetic medium MM moving relative to a magnetic body is assumed, in addition to the magnetic flux density, a transport force of the magnetic medium MM, the gravity acting on the magnetic medium MM, and a friction force acting on the magnetic medium MM may be taken into consideration. Therefore, hereinafter, a description will be made of conditions in which the moving magnetic medium MM is not adsorbed by transport guides 71, 73, 74 and 75 due to a magnetic force. In addition, herein, the fifth transport guide 75 is selected as a representative among the transport guides 71, 73, 74 and 75.

Figure 7:
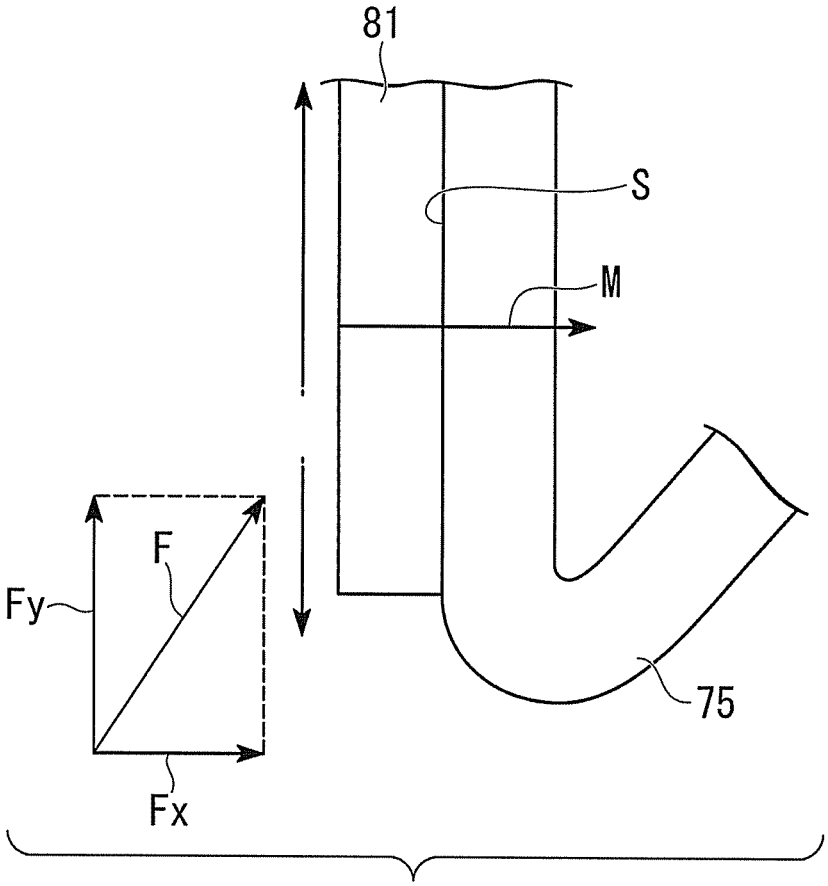
FIG. 7 is an enlarged front view of a part of a guide illustrated in FIG. 4.

FIG. 7 enlarges and illustrates a part of the fifth transport guide 75 (hereinafter, referred to as the transport guide 75). The guide surface S of the transport guide 75 extends vertically. The magnetic medium MM is transmitted in a direction intersecting the guide surface S of the transport guide 75. At this time, when a transport force of the magnetic medium MM is denoted by F, a horizontal component of the transport force F is denoted by Fx, a vertical component of the transport force F is denoted by Fy, a horizontal magnetic attraction force acting on the magnetic medium MM is denoted by M, a dynamic friction coefficient between the magnetic medium MM and the spacer 81 is denoted by μ, mass of the magnetic medium MM is denoted by m, and gravitation acceleration is denoted by g, a friction force acting on the magnetic medium MM from the spacer 81 is (Fx+M)μ. In this case, in order for the magnetic medium MM to be transported without being adsorbed by the transport guide 75 due to a magnetic force, the following Expression (1) is required to be satisfied.

$$Fy>(Fx+M)\mu+mg \quad (1)$$

In other words, the thickness T of the spacer 81 may be set so that the magnetic attraction force M acting on the magnetic medium MM becomes a magnetic attraction force satisfying the above Expression (1)

According to the image forming apparatus 1 with the above configuration, an image formed on the magnetic medium MM can be decolorized without weakening the magnetism of the magnetic medium MM. In other words, if an image formed on the magnetic medium MM is to be decolorized, the magnetic medium MM is required to be heated at a predetermined temperature or higher. However, if a temperature of the magnetic medium MM is equal to or higher than a Curie temperature of a ferromagnet of the magnetic medium MM, the magnetic arrangement of the magnetic medium MM may be in disorder. As a result, the magnetism of the magnetic medium MM may be damaged.

Therefore, the image forming apparatus 1 of the present exemplary embodiment includes the feeding section 27, the fixing section 32, and the control section 23. The magnetic medium MM can be supplied to the feeding section 27. The fixing section 32 decolorizes an image on the magnetic medium MM by heating the magnetic medium MM. The control section 23 controls the fixing section 32 to be set to a temperature which is equal to or higher than a temperature at which the image on the magnetic medium MM can be decolorized and which is lower than a Curie temperature of a ferromagnet of the magnetic medium MM during decolorizing of the magnetic medium MM. With this configuration, a temperature of the magnetic medium MM can be prevented from reaching a level which causes the magnetism of the magnetic medium MM to be damaged during decolorizing of the magnetic medium MM. Consequently, an image formed on the magnetic medium MM can be decolorized without damaging the magnetism of the magnetic medium MM. For this reason, the magnetic medium MM can be repeatedly used. The magnetic medium MM is more expensive than a paper sheet. If the magnetic medium MM can be repeatedly used, cost required to use the magnetic medium MM can be reduced.

In the present exemplary embodiment, the control section 23 controls the fixing section 32 to be set to the first temperature during decolorizing of the non-magnetic medium NMM. On the other hand, the control section 23 controls the fixing section 32 to be set to the second temperature which is lower than the first temperature during decolorizing of the magnetic medium MM. With this configuration, the non-magnetic medium NMM can be heated to a high temperature independent of the Curie temperature of the ferromagnet of the magnetic medium MM during decolorizing of the non-magnetic medium NMM. Thus, the non-magnetic medium NMM can be more reliably decolorized.

In the present exemplary embodiment, the control section 23 causes the non-magnetic medium NMM to pass through the fixing section 32 at the first speed during decolorizing of the non-magnetic medium NMM. On the other hand, the control section 23 causes the magnetic medium MM to pass through the fixing section 32 at the second speed which is lower than the first speed during decolorizing of the magnetic medium MM. With this configuration, the non-magnetic medium NMM can be caused to pass through the fixing section 32 at a relatively high speed during decolorizing of the non-magnetic medium NMM. Consequently, the time required to decolorize the non-magnetic medium NMM can be reduced. This contributes to improving a user's convenience. On the other hand, the magnetic medium MM may be caused to pass through the fixing section 32 at a relatively low speed during decolorizing of the magnetic medium MM. Consequently, even if a temperature of the fixing section 32 is relatively low, the magnetic medium MM can be sufficiently heated by taking a relatively long period of time. Therefore, an image on the magnetic medium MM can be reliably decolorized even if a Curie temperature of a ferromagnet of the magnetic medium MM is not high.

In the present exemplary embodiment, the control section 23 controls the fixing section 32 to be set to the second temperature during decolorizing of the magnetic medium MM1 having a relatively high Curie temperature. On the other hand, the control section 23 controls the fixing section 32 to be set to the third temperature which is lower than the second temperature during decolorizing of the magnetic medium MM2 having a relatively low Curie temperature. With this configuration, the magnetic medium MM1 can be heated to a high temperature independent of the Curie temperature of the ferromagnet of the magnetic medium MM2 during decolorizing of the magnetic medium MM1. Thus, the Magnetic medium MM1 can be more reliably decolorized.

In the present exemplary embodiment, the control section 23 causes the magnetic medium MM1 to pass through the fixing section 32 at the second speed during decolorizing of the magnetic medium MM1. On the other hand, the control section 23 causes the magnetic medium MM2 to pass through the fixing section 32 at the third speed lower than the second speed during decolorizing of the magnetic medium MM2. With this configuration, the magnetic medium MM1 can be caused to pass through the fixing section 32 at a relatively high speed during decolorizing of the magnetic medium MM1. Thus, the time required to decolorize the magnetic medium MM1 can be shortened. On the other hand, the magnetic medium MM2 can be caused to pass through the fixing section 32 at a relatively low speed during decolorizing of the magnetic medium MM2. Consequently, even if a temperature of the fixing section 32 is relatively low, the magnetic medium MM2 can be sufficiently heated by taking a relatively long period of time.

In the present exemplary embodiment, the control section 23 controls the fixing section 32 to be set to a temperature which is equal to or higher than a temperature at which toner can be fixed to the magnetic medium MM and which is lower than the Curie temperature of the ferromagnet of the magnetic medium MM during printing of the magnetic medium MM. With this configuration, also during printing of the magnetic medium MM, a temperature of the magnetic medium MM can be prevented from becoming high. Thus, an image can be formed on the magnetic medium MM without damaging the magnetism of the magnetic medium MM.

Also during printing, the control section 23 may manage a temperature of the fixing section 32 so as to be at a plurality of temperatures in stages such as the above-described first to third temperatures. Also during printing, the control section 23 may manage a speed at which the medium M passes through the fixing section 32 so as to be at a plurality of speeds in stages such as the above-described first to third speeds.

The image forming apparatus 1 of the present exemplary embodiment includes the transport guides 71, 73, 74 and 75. The transport guides 71, 73, 74 and 75 are in contact with the transport path 26 of the magnetic medium MM. The transport guides 71, 73, 74 and 75 have magnetism. For this reason, the magnetic medium MM may be adsorbed by the transport guides 71, 73, 74 and 75 due to a magnetic force. As a result, the magnetic medium MM may be inconvenient to transport.

Therefore, in the present exemplary embodiment, the image forming apparatus 1 includes the spacer 81. The spacer 81 is attached to each of the transport guides 71, 73, 74 and 75. The spacer 81 is provided between each of the transport guides 71, 73, 74 and 75 and the transport path 26. The spacer 81 separates the magnetic medium MM passing along the transport path 26 from each of the transport guides 71, 73, 74 and 75. With this configuration, the magnetic medium MM can be prevented from being adsorbed by the transport guides 71, 73, 74 and 75 due to a magnetic force. Thus, the magnetic medium MM can be reliably transported.

In the present exemplary embodiment, the spacer 81 has the thickness of T of 1 mm or more between each of the transport guides 71, 73, 74 and 75 and the transport path 26. With this configuration, as illustrated in FIG. 6, a substantial magnetic force is not generated between the transport guides 71, 73, 74 and 75 and the magnetic medium MM. Consequently, the magnetic medium MM can be more reliably prevented from being adsorbed by the transport guides 71, 73, 74 and 75 due to a magnetic force.

In the present exemplary embodiment, the spacer 81 is a non-magnetic member which is attached to each of the transport guides 71, 73, 74 and 75. With this configuration, the magnetic medium MM can be more reliably prevented from being adsorbed by the spacer 81 due to a magnetic force. Thus, the magnetic medium MM can be more reliably transported.

In the present exemplary embodiment, the spacer 81 is the flexible sheet 81*a* attached to each of the transport guides 71, 73, 74 and 75 so as to be suitable as an exterior of each of the transport guides 71, 73, 74 and 75. With this configuration, the spacer 81 can be easily disposed even if a shape of the transport path 26 is complex. This contributes to reducing the cost of the image forming apparatus 1.

In the present exemplary embodiment, the image forming apparatus 1 includes the feeding section 27, the transfer sections 25 and 30, the fixing section 32, and the control section 23. The transfer sections 25 and 30 transfer an image onto the magnetic medium MM by using decolorable non-magnetic toner during printing of the magnetic medium MM. The fixing section 32 fixes the toner to the magnetic medium MM by heating and pressing the magnetic medium MM onto which the toner is transferred during printing of the magnetic medium MM. Here, if an image is transferred onto the magnetic medium MM by using magnetic toner, the toner may be attracted thereto due to the magnetism of the magnetic medium MM. For this reason, the toner may not be transferred to an intended position on the surface of the magnetic medium MM. Therefore, in the present exemplary embodiment, an image is formed on the magnetic medium MM by using non-magnetic toner. With this configuration, when toner is transferred onto the magnetic medium MM, the toner can be transferred to an intended position on the surface of the magnetic medium. For this reason, an image can also be formed on the magnetic medium MM with high accuracy.

Second Exemplary Embodiment

Next, with reference to FIG. 8, an image forming apparatus 1 according to a second exemplary embodiment will be described. In the image forming apparatus 1 of the present exemplary embodiment, a shape or the like of the spacer 81 is different from the shape or the like of the spacer 81 in the first exemplary embodiment. Remaining configurations of the second exemplary embodiment are the same as the configurations of the first exemplary embodiment. For this reason, description of portions identical to the portions in the first exemplary embodiment will be omitted.

Figure 8:
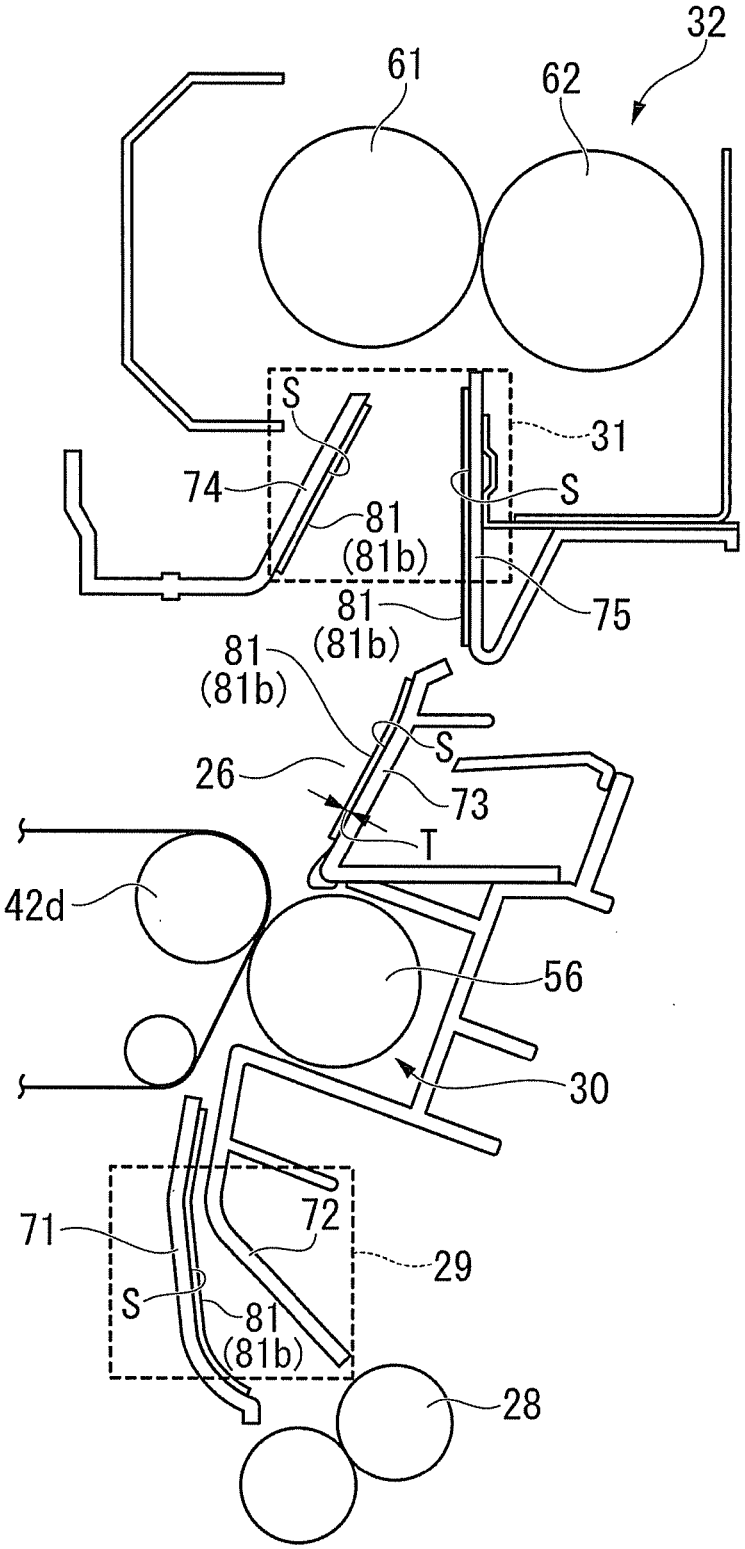
FIG. 8 is a front view illustrating a transport path of an image forming apparatus according to a second exemplary embodiment.

As illustrated in FIG. 8, the spacer 81 of the present exemplary embodiment is a rib 81*b* provided on the guide surface S of each of the transport guides 71, 73, 74 and 75. The rib 81*b* extends in the transport direction of the magnetic medium MM. For example, a protruding height T (a height from the guide surface S) of the rib 81*b* is 1 mm or more. For example, the rib 81*b* is provided in a plurality. For example, the plurality of ribs 81*b* are arranged in a direction (a depth direction of the plane of FIG. 8) substantially perpendicular to the transport direction of the magnetic medium MM.

For example, the rib 81*b* is integrally formed with each of the transport guides 71, 73, 74 and 75. In other words, the rib 81*b* is made of the same material (magnetic body) of the transport guides 71, 73, 74 and 75. The rib 81*b* is partially provided on the guide surface S of each of the transport guides 71, 73, 74 and 75. For this reason, a contact area between the rib 81*b* and the magnetic medium MM is sufficiently small. For this reason, a magnetic force which causes inconvenience in transporting the magnetic medium MM does not act between the rib 81*b* and the magnetic medium MM.

With this configuration, in the same manner as in the first exemplary embodiment, the magnetic medium MM can be prevented from being adsorbed by the transport guides 71, 73, 74 and 75 due to a magnetic force. Thus, the magnetic medium MM can be reliably transported.

In the present exemplary embodiment, the spacer 81 is the rib 81*b* provided on each of the transport guides 71, 73, 74 and 75. With this configuration, manufacturing cost of the spacer 81 can be reduced.

Third Exemplary Embodiment

Next, with reference to FIG. 9, a decolorizing apparatus 90 according to a third exemplary embodiment will be described. The decolorizing apparatus 90 of the present exemplary embodiment is an apparatus used for decolorization only. In the same manner as in the first exemplary embodiment, both the non-magnetic medium NMM and the magnetic medium MM can be supplied to the decolorizing apparatus 90. In addition, description of portions identical to the portions in the first exemplary embodiment will be omitted.

Figure 9:
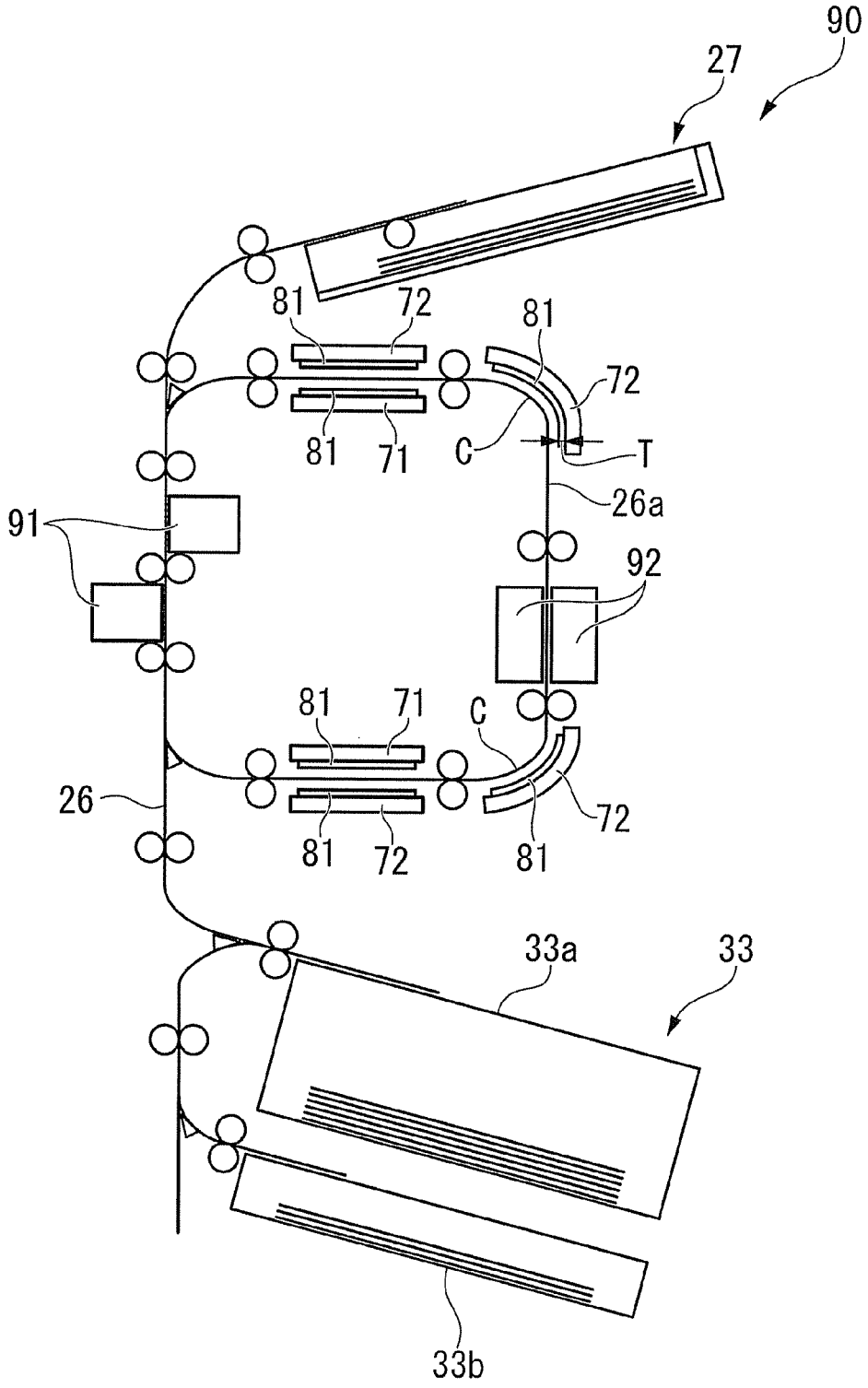
FIG. 9 is a diagram schematically illustrating a configuration example of a decolorizing apparatus according to a third exemplary embodiment.

FIG. 9 illustrates a configuration example of the decolorizing apparatus 90. The decolorizing apparatus 90 includes the transport path 26, the feeding section 27, a reading section 91, the discharging section 33, a decolorizing section 92, and the control section 23.

The transport path 26 reaches the discharging section 33 from the feeding section 27 via the reading section 91 and the decolorizing section 92. The transport path 26 of the present exemplary embodiment includes an annular transport path 26*a* which guides the medium M passing through the reading section 91 and the decolorizing section 92 to the reading section 91 again.

The reading section 91 is provided in the middle of the transport path 26. The reading section 91 reads an image on the medium M. For example, the reading section 91 simultaneously reads images on both sides of the medium M passing along the transport path 26. For example, the reading section 91 is a charge coupled device (CCD) image sensor. The reading section 91 sends a read result to the control section 23.

The decolorizing section 92 decolorizes an image on the medium M by heating the medium M. For example, the decolorizing section 92 simultaneously decolorizes images on both sides of the medium M passing along the transport path 26. The medium M undergoing the decolorization in the decolorizing section 92 is forwarded to the reading section 91 again. The reading section 91 detects a decolorized state of the medium M passing through the decolorizing section 92.

The discharging section 33 includes a reusable paper tray 33*a* and a non-reusable paper tray 33*b*.

The control section 23 forwards the medium M to the reusable paper tray 33*a* if the decolorization of the medium M is sufficiently performed on the basis of a detection result from the reading section 91. On the other hand, the control section 23 forwards the medium M to the non-reusable paper tray 33*b* if the decolorization of the medium M is not sufficiently performed on the basis of a detection result from the reading section 91.

An operation of the control section 23 is substantially the same as the operation of the control section 23 in the decolorizing mode of the first exemplary embodiment. In other words, the control section 23 controls the fixing section 32 to be set to a temperature which is equal to or higher than a temperature at which an image formed on the magnetic medium MM can be decolorized and which is lower than the Curie temperature of the ferromagnet of the magnetic medium MM during decolorizing of the magnetic medium MM.

Next, transport guides 71 and 72 of the present exemplary embodiment will be described.

As illustrated in FIG. 9, the decolorizing apparatus 90 includes first and second transport guides 71 and 72. A plurality of first transport guides 71 are disposed inside the annular transport path 26*a*. A plurality of second transport guides 72 are disposed outside the annular transport path 26*a*. Some of the second transport guides 72 are disposed outside corners C of the annular transport path 26*a*. The magnetic medium MM transported along the annular transport path 26*a* is mainly guided by the second transport guides 72.

In the present exemplary embodiment, the spacer 81 is attached to each of the second transport guides 72. For example, the spacer 81 may be the sheet 81*a* formed of a non-magnetic member in the same manner as in the first exemplary embodiment. The spacer 81 may be the rib 81*b* provided on the second transport guide 72 in the same manner as in the second exemplary embodiment. The spacer 81 may be provided on each of the first transport guides 71. The transport guides 71 and 72 and the spacers 81 may be provided on the transport path 26 in portions other than the annular transport path 26*a*.

With this configuration, in the same manner as in the first exemplary embodiment, an image formed on the magnetic medium MM can be decolorized without damaging the magnetism of the magnetic medium MM. In addition, in the same manner as in the first and second exemplary embodiments, the magnetic medium MM can be prevented from being adsorbed by the transport guides 71 and 72 due to a magnetic force. Thus, the magnetic medium MM can be reliably transported.

While certain embodiments have been described these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and their equivalents are intended to cover such forms or modifications as would fall within the scope and spirit or the invention.

What is claimed is:

1. A decolorizing apparatus comprising:

a feeding section configured to supply a magnetic medium having a ferromagnet in at least a part thereof;

a decolorizing section configured to decolorize a decolorable image formed on the magnetic medium by heating the magnetic medium; and a control section configured to control the decolorizing section to be set to a temperature which is equal to or higher than a temperature at which the image is decolorized and is lower than a Curie temperature of the ferromagnet of the magnetic medium during decolorizing of the magnetic medium.

2. The apparatus according to claim 1, wherein the feeding section supplies a non-magnetic medium on which a decolorable image is formed, and wherein the control section controls the decolorizing section to be set to a first temperature during decolorizing of the non-magnetic medium and controls the decolorizing section to be set to a second temperature which is lower than the first temperature during decolorizing of the magnetic medium.

3. The apparatus according to claim 2, wherein the control section causes the non-magnetic medium to pass through the decolorizing section at a first speed during decolorizing of the non-magnetic medium, and causes the magnetic medium to pass through the decolorizing section at a second speed which is lower than the first speed during decolorizing of the magnetic medium.

4. The apparatus according to claim 1, further comprising:

a transport guide that is in contact with a transport path of the magnetic medium and has magnetism; and a spacer that is provided between the transport path and the transport guide and separates the magnetic medium passing along the transport path from the transport guide.

5. The apparatus according to claim 4, wherein the spacer has a thickness of 1 mm or more between the transport path and the transport guide.

6. The apparatus according to claim 4, wherein the spacer is a non-magnetic member attached to the transport guide.

7. The apparatus according to claim 6, wherein the spacer is a flexible sheet attached to the transport guide so as to be suitable as an exterior of the transport guide.

8. The apparatus according to claim 4, wherein the spacer is a rib which is provided on a surface of the transport guide and extends in a transport direction of the magnetic medium.

9. An image forming apparatus comprising:

a feeding section configured to supply a magnetic medium having a ferromagnet in at least a part thereof;

a transfer section configured to transfer an image onto the magnetic medium by using decolorable non-magnetic toner during printing of the magnetic medium;

a fixing section configured to fix the toner to the magnetic medium by heating and pressing the magnetic medium onto which the toner is transferred during printing of the magnetic medium, and decolorize a decolorable image formed on the magnetic medium by heating the magnetic medium during decolorizing of the magnetic medium; and a control section configured to control the fixing section to be set to a temperature which is equal to or higher than a temperature at which the image is decolorized and which is lower than a Curie temperature of the ferromagnet of the magnetic medium during decolorizing of the magnetic medium.

10. A decolorizing method comprising:

supplying a magnetic medium having a ferromagnet in at least a part thereof; and decolorizing an image formed on the magnetic medium by heating the magnetic medium at a temperature which is equal to or higher than a temperature at which the image is decolorized and is lower than a Curie temperature of the ferromagnet of the magnetic medium.

* * * * *